US010220436B2

(12) United States Patent
Honsel

(10) Patent No.: US 10,220,436 B2
(45) Date of Patent: Mar. 5, 2019

(54) METHOD FOR REMOVING A BLIND RIVET ELEMENT FROM A RIVETING DEVICE

(71) Applicant: VVG-BEFESTIGUNGSTECHNIK GMBH & CO., Neumuenster (DE)

(72) Inventor: Michael H. Honsel, Esgrus (DE)

(73) Assignee: VVG-BEFESTIGUNGSTECHNIK GMBH & CO., Neumuenster (DE)

( * ) Notice: Subject to any disclaimer, the term of this patent is extended or adjusted under 35 U.S.C. 154(b) by 117 days.

(21) Appl. No.: 15/268,641

(22) Filed: Sep. 19, 2016

(65) Prior Publication Data

US 2017/0080480 A1 Mar. 23, 2017

(30) Foreign Application Priority Data

Sep. 21, 2015 (DE) ..... 10 2015 115 869

(51) Int. Cl.

| | |
|---|---|
| ***B21J 15/38*** | (2006.01) |
| ***B21J 15/26*** | (2006.01) |
| ***B21J 15/36*** | (2006.01) |
| ***B25B 27/00*** | (2006.01) |

(52) U.S. Cl.

CPC ..... *B21J 15/36* (2013.01); *B21J 15/26* (2013.01); *B25B 27/0014* (2013.01)

(58) Field of Classification Search

CPC ..... B21J 15/03; B21J 15/26; B25B 27/0014
See application file for complete search history.

(56) References Cited

U.S. PATENT DOCUMENTS

| | | | | |
|---|---|---|---|---|
| 5,605,070 | A * | 2/1997 | Wille | B25B 27/0014 72/114 |
| 2015/0196951 | A1 | 7/2015 | Bigot et al. | |
| 2016/0114383 | A1* | 4/2016 | Honsel | B25B 27/0014 29/525.07 |

FOREIGN PATENT DOCUMENTS

| | | | |
|---|---|---|---|
| CN | 201055899 | Y | 5/2008 |
| CN | 202105966 | U | 1/2012 |
| CN | 104776101 | A | 7/2015 |
| DE | 44 06 946 | A1 | 9/1995 |
| DE | 295 02 918 | U1 | 6/1996 |
| DE | 10 2013 105 703 | A1 | 12/2014 |
| GB | 2 306 368 | A | 5/1997 |

* cited by examiner

*Primary Examiner* — John C Hong
(74) *Attorney, Agent, or Firm* — Norman B. Thot

(57) ABSTRACT

A method for removing a blind rivet element from a riveting device. The riveting device includes a connecting device, a mandrel, a rotary drive which rotates the connecting element around a rotational axis of the connecting element, and a longitudinal drive which axially drives the connecting element relative to the rotational axis. The blind rivet element is screwed onto the mandrel of the riveting device. The mandrel is connected to the connecting element on the riveting device. The method includes starting an emergency program via a user input on the riveting device. The emergency program includes the steps of rotating the connecting element with the rotary drive in a rotating direction to separate the connection between the mandrel and the connecting element, and, upon reaching a default, stopping the rotation of the connecting element with the rotary drive.

8 Claims, 6 Drawing Sheets

METHOD FOR REMOVING A BLIND RIVET ELEMENT FROM A RIVETING DEVICE

CROSS REFERENCE TO PRIOR APPLICATIONS

Priority is claimed to German Patent Application No. DE 10 2015 115 869.8, filed Sep. 21, 2015. The entire disclosure of said application is incorporated by reference herein.

FIELD

The present invention relates to a method for removing a blind rivet element from a riveting device.

BACKGROUND

In the method, the blind rivet element is screwed to a mandrel of the riveting device via a first thread arrangement. The mandrel is further connected to a connecting element on the riveting device by a second thread arrangement. The riveting device comprises a longitudinal drive for driving the connecting element axially, as well as a rotary drive for driving the connecting element rotationally, relative to a rotational axis of the connecting element, respectively.

A riveting device of this type has previously been described, for example, in DE 10 2013 105 703 A1.

However, damage to the first thread arrangement frequently occur in such riveting devices and the rivet setting processes carried out thereby. Such damage can occur due to high setting forces when setting blind rivet elements that lead to irreversible damage of the thread on the mandrel or on the blind rivet element. However, the torque of the motor is merely adjusted for screwing the mandrel into and out of the blind rivet element when the thread is undamaged. A user has therefore to date had no option but to screw off the mandrel between the blind rivet element and the connecting element or sawing off the mandrel. This can, however, lead to damage on the blind rivet element, on the workpiece to be fastened, or on the riveting device itself. It is also time-consuming.

SUMMARY

An aspect of the present invention is to simplify the removal of a blind rivet element from a riveting device after the setting process, particularly in instances where the mandrel can no longer be conventionally screwed off the blind rivet element due to damage of the first thread arrangement.

In an embodiment, the present invention provides a method for removing a blind rivet element from a riveting device. The blind rivet element comprises a first internal thread. The riveting device comprises a connecting device which comprises a second internal thread and a rotational axis, a mandrel which comprises a first external thread and a second external thread, a rotary drive configured to rotate the connecting element around the rotational axis of the connecting element, and a longitudinal drive configured to drive the connecting element in an axial direction relative to the rotational axis. The blind rivet element is screwed onto the mandrel of the riveting device by a first thread arrangement comprising the first external thread of the mandrel and the first internal thread of the blind rivet element. The mandrel is connected to the connecting element on the riveting device by a second thread arrangement comprising the second external thread of the mandrel and the second internal thread of the connecting device. The method comprises starting an emergency program via a user input on the riveting device. The emergency program comprises the steps of rotating the connecting element with the rotary drive in a rotating direction to separate the connection between the mandrel and the connecting element provided by the second thread arrangement, and, upon reaching a default, stopping the rotation of the connecting element with the rotary drive.

BRIEF DESCRIPTION OF THE DRAWINGS

The present invention is described in greater detail below on the basis of embodiments and of the drawings in which.

DETAILED DESCRIPTION

Figure 1:
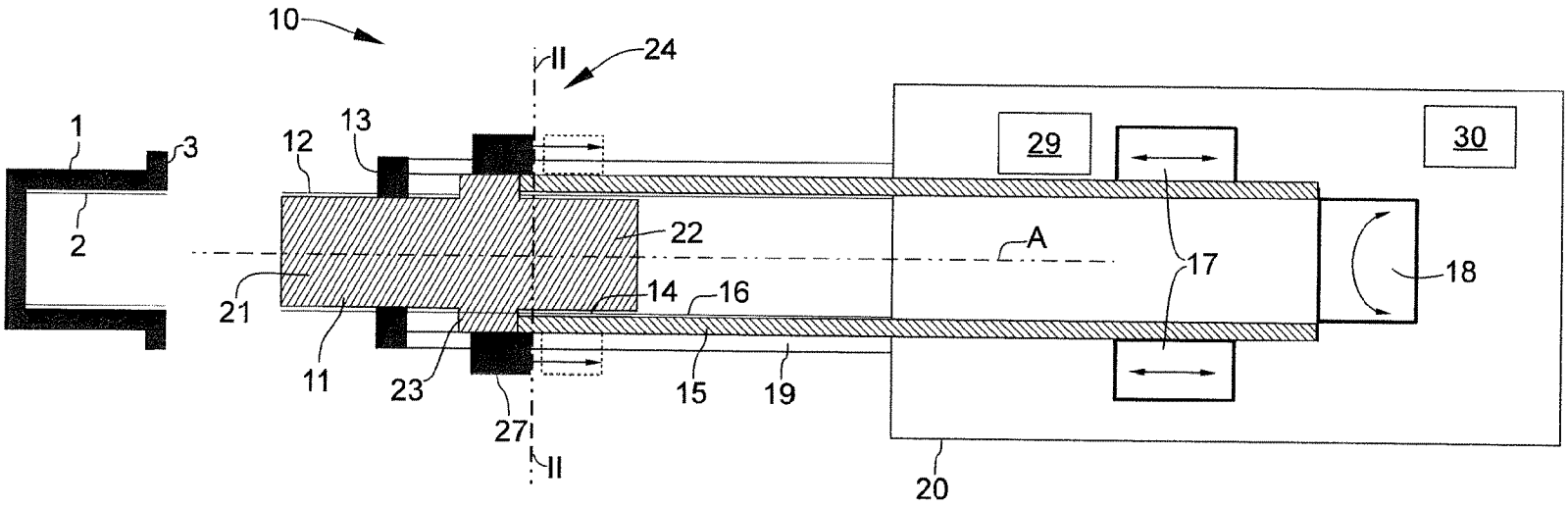
FIG. 1 shows a cross section of the structure of an inventive riveting device with a corresponding blind rivet element.

The present invention proposes that an emergency program be started based on a user input on the riveting device. The emergency program causes the connecting element to be driven by the rotary drive in a rotating direction so that the connection between the mandrel and the connecting element in the form of the second thread arrangement is separated. The emergency program also causes the rotary drive to stop driving the connecting element after a default has been reached.

The core aspect of the present invention is that the user must no longer contemplate how to separate the blind rivet element from the riveting device despite a damaged first thread arrangement. The user must merely start the emergency program in such instances. The connecting element then is initially driven by the rotary drive so that the mandrel is separated from the connecting element via the other, still intact, second thread arrangement. The rotation automatically stops as soon as the mandrel is separated from the connecting element. The riveting device including the housing and the connecting element is thereby initially removed from the blind rivet element. Only the mandrel remains on the blind rivet element. The mandrel can then be manually separated from the blind rivet element with a separate tool such as, for example, a conventional wrench that can be attached to the mandrel. The use of corresponding tools in this context also makes it possible to exert torques that considerably exceed the maximum torque of the riveting device so that the mandrel can be screwed off the blind rivet element despite the damaged first thread arrangement. The mandrel can be conventionally sawed off should this also proove impossible. This sawing process is, however, now much easier because the riveting device is already removed.

In an embodiment of the present invention, a rotational lock, via which the mandrel is held on the connecting element in a rotationally locked fashion, can, for example, initially be disengaged. The connecting element is not driven by the rotary drive until this disengagement has taken place.

The state of the rotational lock can, for example, be monitored by a sensor in this case. The rotary drive is not activated and the separation of the mandrel from the connecting element does not begin until the sensor detects that the rotational lock has been disengaged.

In an embodiment of the present invention, the connecting element can, for example, also be at least intermittently driven axially into the housing of the riveting device by the longitudinal drive while it is driven by the rotary drive. The connecting element therefore is retracted into the housing of the riveting device while the connecting element is simultaneously screwed off the mandrel due to its rotational motion. The axial advance of the connecting element caused by the thread rotation can thereby be compensated with the longitudinal drive. The axial relative motion between the housing of the riveting device and the blind rivet element can thereby be reduced.

In an embodiment of the present invention, the rotary drive and the longitudinal drive can, for example, be synchronized with one another so that an axial clearance between the housing of the riveting device and the blind rivet element is constantly maintained while the connecting element is driven by the rotary drive. The axial advance can be calculated based on the thread pitch and the rotational speed applied to the connecting element.

The housing in this context represents in particular a casing around parts of the riveting device. Handles via which the user can hold the riveting device are in particular rigidly arranged on the housing.

In an embodiment of the present invention, a rotary encoder can, for example, be arranged on the riveting device in order to determine the rotational position of the rotary drive. It can then be determined how many revolutions the connecting element has already carried out based on the known rotational position of the rotary drive. This in turn makes it possible to determine the time at which the connecting element is completely screwed off the mandrel. This time can then serve as the default value that ultimately represents the condition for stopping the connecting element from being driven by the rotary drive.

The present invention also provides a riveting device with a control unit which is configured to control a method as set forth above.

The present invention is described in greater detail below under reference to the drawings.

FIG. 1 shows a riveting device 10 designed to carry out the method of the present invention. The riveting device 10 comprises a housing 20 in which a schematically indicated longitudinal drive 17 and a schematically indicated rotary drive 18 are arranged. The two drives 17 and 18 may be provided as described in DE 10 2013 105 703 A1. The longitudinal drive 17 serves to drive the connecting element 15 relative to the housing 20 along the rotational axis A of the connecting element 15. The rotary drive 18 serves to rotate the connecting element 15 relative to the housing 20 about its rotational axis A.

The connecting element 15 is realized in the form of a sleeve and is mounted in the housing 20 to be axially displaceable and rotatable. One end of the connecting element 15 protrudes from the housing and features a second internal thread 16 in the form of a left- handed thread on its inner circumferential surface. A mandrel 11 is screwed into the second internal thread. The mandrel 11 features a second thread section 22 in the form of a second external thread 14 which is likewise left-handed for this purpose.

The connecting element 15 is guided within a guide sleeve 19 that is rigidly connected to the housing 20. A rotational lock 24 prevents the mandrel 11 from rotating relative to the connecting element 15. The rotational lock 24 therefore holds the mandrel 11 in a rotationally locked fashion relative to the connecting element 15. If the connecting element 15 is now set in rotation by the rotary drive 18, the mandrel 11 is also set in rotation depending on the rotating direction. A relative motion between the connecting element 15 and the mandrel 11 is, however, possible when the rotational lock 24 is disengaged. The mandrel 11 can, for example, be held with one hand while the rotary drive 18 sets the connecting element in rotation. The mandrel 11 can then be screwed on or screwed off the connecting element 15 depending on the direction of rotation.

The rotational lock 24 comprises a locking section 23 of the mandrel 11 in the form of a hexagon head 25 on its outer circumference. The hexagon head 25 is accommodated in an axially displaceable locking sleeve 27 with a hexagon socket 26 that is provided complementary to the hexagon head 25. The locking sleeve 27 is likewise rotationally locked, but is axially displaceable relative to the connecting element 15.

FIG. 1 shows the locking sleeve 27 in a locking position in which the hexagon head 25 is enclosed by the hexagon socket 26 so that a rotational lock between the connecting element 15 and the mandrel 11 is formed. The locking sleeve 27 is in its release position when it is axially displaced into the position illustrated with broken lines in FIG. 1 in the direction of the arrow. In this release position, the hexagon head 25 and the hexagon socket 26 are disengaged and a relative motion between the connecting element 25 and the mandrel 11 can take place.

Figure 2:
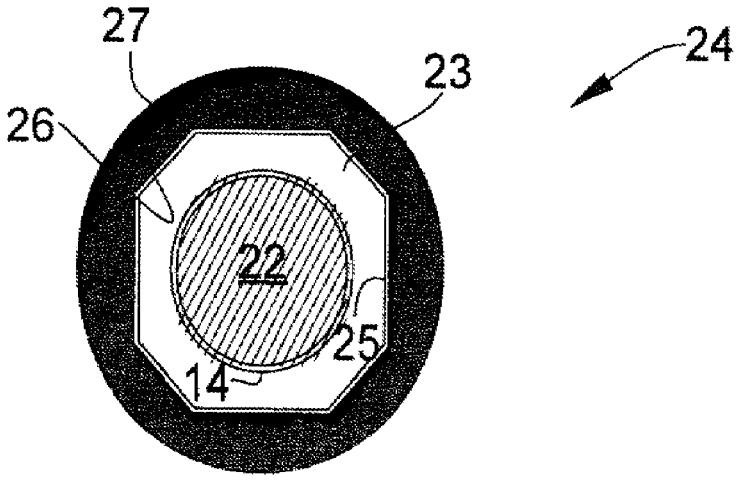
FIG. 2 shows a cross section of a locking mechanism of the riveting device according to FIG. 1 along the line II-II in FIG. 1.

FIG. 2 shows a simplified rotational lock comprising the locking section 23 of the mandrel 11 with the locking sleeve 27 in the form of a cross section along the line II-II. A detailed illustration of the guide sleeve 19 and of the connecting element 15 was omitted in FIG. 2 for the sake of simplicity.

The mandrel 11 furthermore features a first thread section 21 in the form of a first external thread 12, in this case a right-handed thread. This first external thread 21 is screwed into a first internal thread 2 of a blind rivet element 1 in order to prepare the rivet setting process. The blind rivet element 1 is here realized in a pot-shaped fashion and features a stop collar 3. A mouth piece 13 on the guide sleeve 19 serves as stop for the stop collar 3 when the blind rivet element 1 is set.

The riveting device 10 also comprises a control unit 30 that activates the longitudinal drive 17 and the rotary drive 18. A rotary encoder 29 is furthermore provided in order to determine the rotational position of the connecting element 15 and/or the rotary drive 18. The rotary encoder 29 may also form part of a rotary drive 18 with a brushless motor.

In order to set the blind rivet element 1, the blind rivet element 1 is initially screwed into the first internal thread of the mandrel 11. The connecting element 15 is in this case set in rotation for a few revolutions by the rotary drive 18 so that the mandrel 11, which is connected to the connecting element 15 in a rotationally locked fashion, is screwed onto the blind rivet element 1. The longitudinal drive 17 is then abruptly set in motion and retracts the connecting element 15 into the housing 20. The mouth piece 13, however, remains in its position relative to the housing 20 and comes in contact with the stop collar 3. The blind rivet element 1 is properly deformed and thereby set due to the pressure exerted upon the stop collar 3 by the mouth piece 13 as well as by the simultaneous tensile loading of the rightwardly moving first thread section 21 and the associated tension exerted upon the thread 2.

Figure 3:
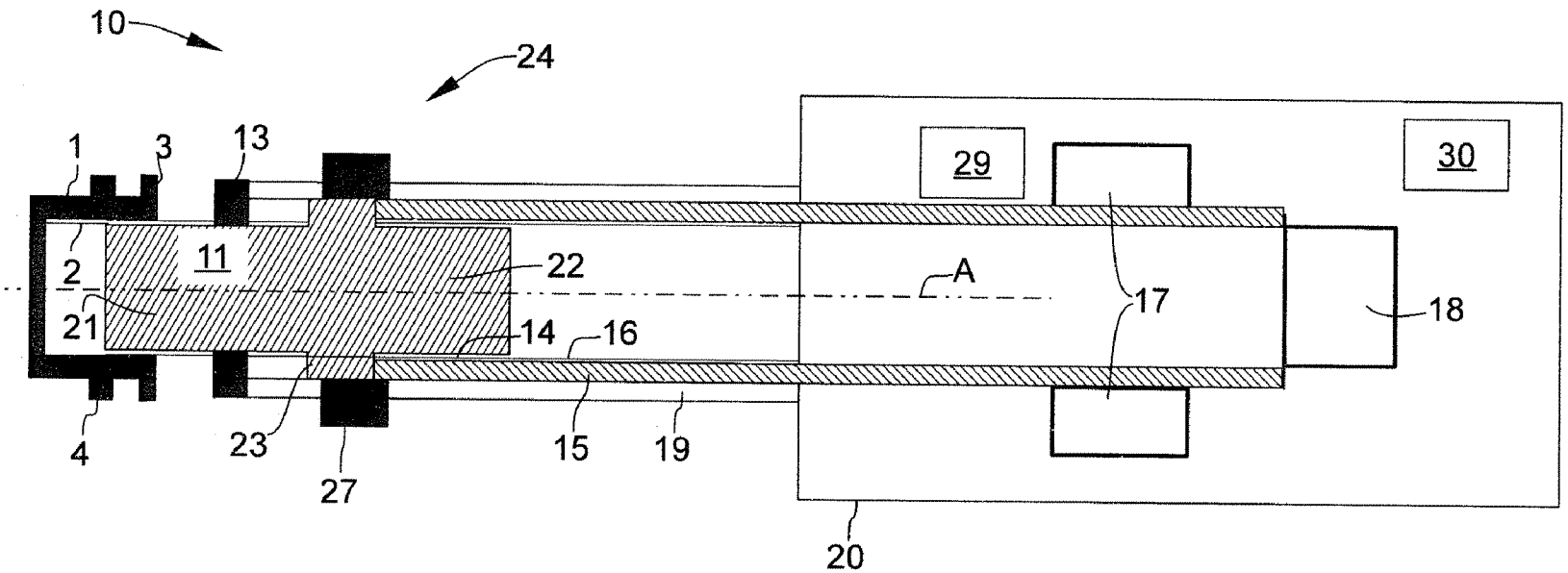
FIG. 3 shows the riveting device according to FIG. 1 in a first phase of the inventive method.

FIG. 3 shows the state of the riveting device and the blind rivet element 1 installed thereon after the riveting process. Due to the aforementioned tension exerted by the thread, a closing bead 4 has been formed on the blind rivet element 1 which produces the interlock with a (not-shown) component in a receptacle bore thereof. The rotary drive 18 would now usually rotate in the counterclockwise direction so that the mandrel 11 would also rotate in the counterclockwise direction with the result that the mandrel 11 would thereby be screwed off the blind rivet element 1. In the present example, however, the first internal thread 2 of the blind rivet element 1 or the first external thread 12 of the mandrel was damaged during the setting process such that the mandrel 11 is no longer rotatable relative to the blind rivet element 1.

Figure 4:
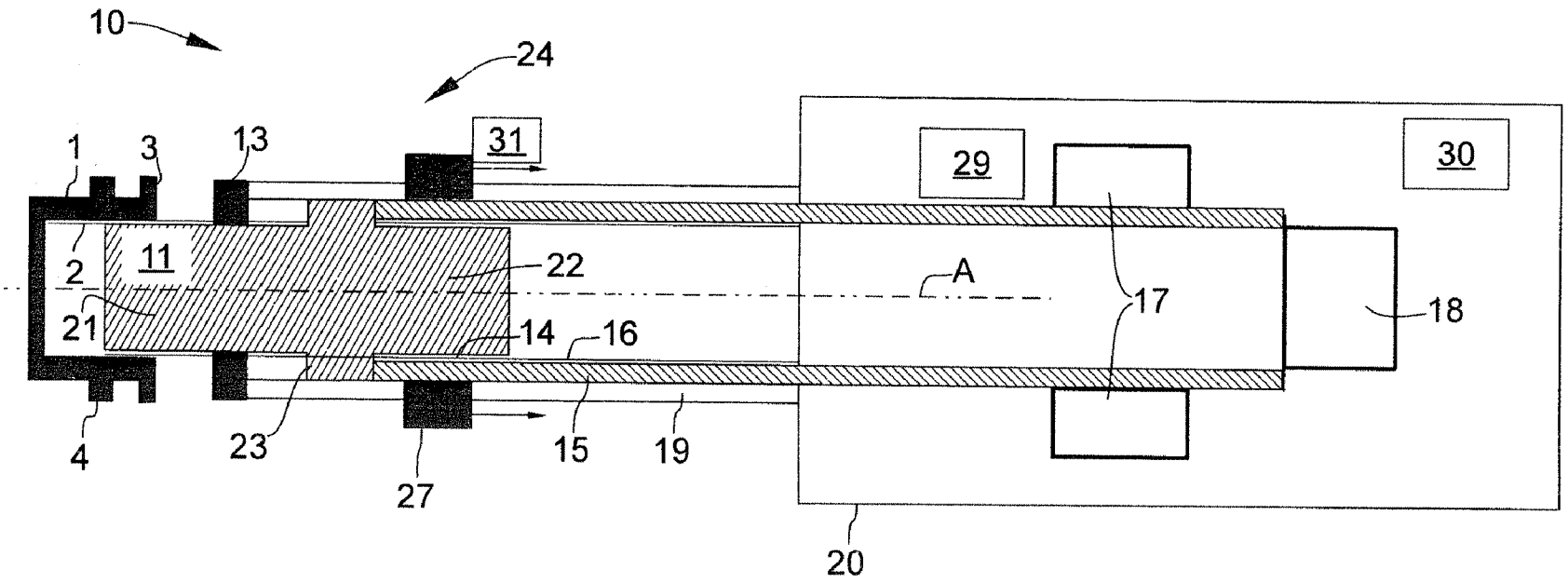
FIG. 4 shows the riveting device according to FIG. 1 in a second phase of the inventive method.

An emergency program is now started in order to nevertheless remove the riveting device 10 from the blind rivet element 1. This is realized, for example, by the user pressing a certain key or key combination on the riveting device 10. The locking sleeve 27 is then pulled in the direction of the housing 20 by the user as shown in FIG. 4 so that the rotational lock 24 between the connecting element 15 and the mandrel 11 is released. A rotational lock sensor 31, which is only illustrated in FIG. 4, detects that the locking sleeve 27 is in its release position and therefore that the rotational lock 24 is released. This causes the rotary drive 18 to start rotating in the clockwise direction so that the connecting element 50 is slowly screwed off the mandrel 11. The longitudinal drive 17 is simultaneously actuated and causes a displacement of the connecting element 15 into the housing 20. In the present figure, the connecting element 15 is moved rightward so that the relative alignment between the mandrel 11 and the housing 20 remains essentially unchanged.

It is determined how many revolutions the connecting element 15 has already carried out by integrating values acquired by the rotary encoder 29. The rotary drive 18 is automatically stopped after a certain number of revolutions. This is the case once the connecting element 15 is completely screwed off the mandrel 11. A default value in the form of the number of required revolutions may, for example, be used in this case. This default value is specific to the mandrel 11 because the mandrel 11 comprises, for example, five turns so that five revolutions are required to separate the mandrel from the connecting element 15.

Figure 5:
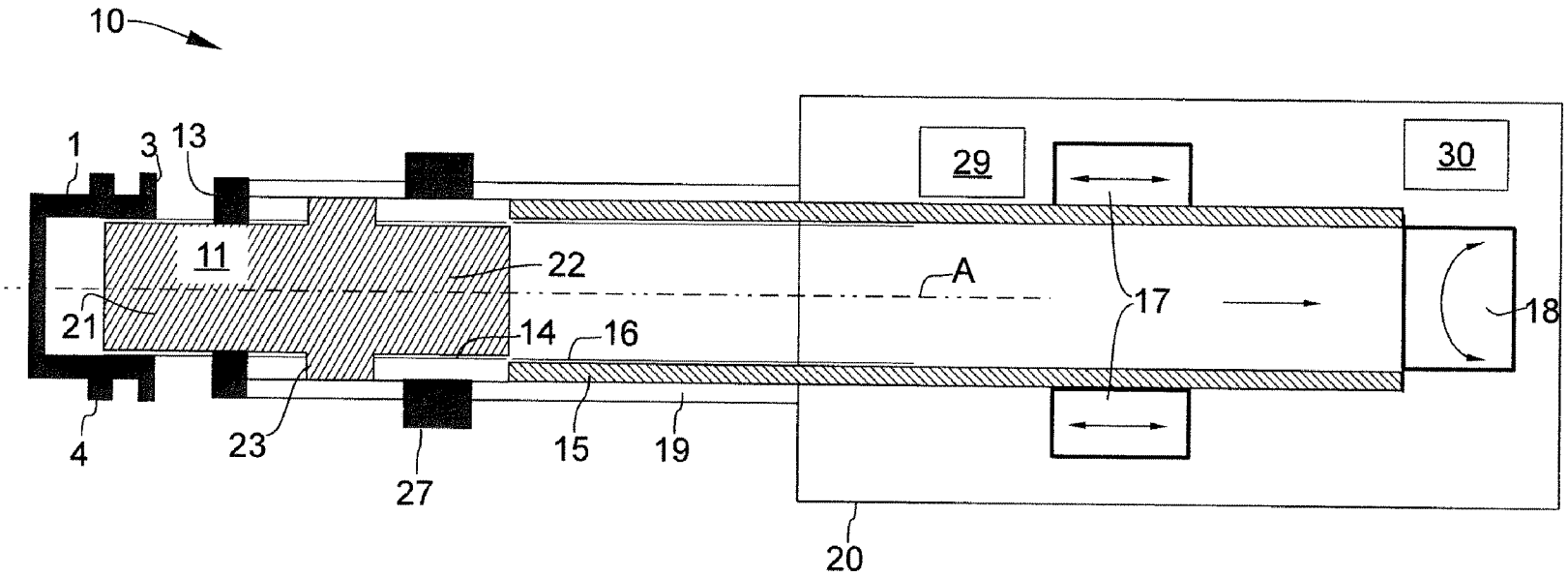
FIG. 5 shows the riveting device according to FIG. 1 in a third phase of the inventive method.
Figure 6:
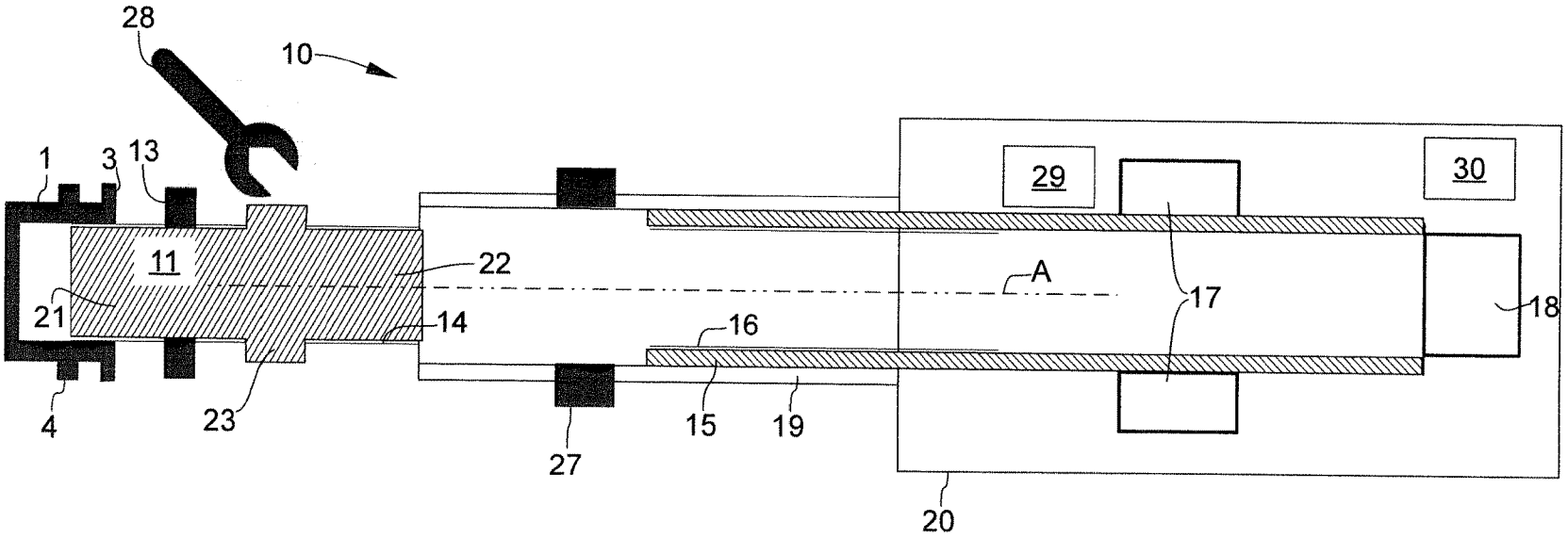
FIG. 6 shows the riveting device according to FIG. 1 in a fourth phase of the inventive method.

The state is illustrated in FIG. 5. The screw connection between the second external thread 14 and the second internal thread 16 is separated. The mandrel 11 can now be removed from the riveting device 10 together with the blind rivet element 1 fixed thereon as illustrated in FIG. 6. The blind rivet element 1 is still located in the (not-shown) receptacle bore of the workpiece. The mandrel 11 is also still fixed on the blind rivet element 1. A conventional wrench 28 can now be attached to the locking section 23 of the mandrel 11 in order to manually separate the mandrel 11 from the blind rivet element 1.

The present invention is not limited to embodiments described herein; reference should be had to the appended claims.

LIST OF REFERENCE NUMERALS

1 Blind rivet element
2 First internal thread (right-handed thread) of blind rivet element
3 Stop collar of blind rivet element
4 Closing bead
10 Riveting device
11 Mandrel
12 First external thread (right-handed thread) of mandrel
13 Mouth piece
14 Second external thread (left-handed thread) of mandrel
15 Connecting element
16 Second internal thread (left-handed thread) of connecting element
17 Longitudinal drive
18 Rotary drive
19 Guide sleeve
20 Housing
21 First thread section of mandrel
22 Second thread section of mandrel
23 Locking section of mandrel
24 Rotational lock
25 Hexagon head of locking section
26 Hexagon socket of locking sleeve
27 Locking sleeve
28 Wrench
29 Rotary encoder
30 Control unit
31 Rotational lock sensor
A Rotational axis

What is claimed is:

1. A method for removing a blind rivet element from a riveting device, the method comprising:
providing a blind rivet element comprising a first internal thread;
providing a riveting device comprising:
a connecting element which comprises a second internal thread and a rotational axis,
a mandrel which comprises a first external thread and a second external thread,
a rotary drive configured to rotate the connecting element around the rotational axis of the connecting element, and
a longitudinal drive configured to drive the connecting element in an axial direction relative to the rotational axis,
wherein,
the blind rivet element is screwed onto the mandrel of the riveting device by a first thread arrangement comprising the first external thread of the mandrel and the first internal thread of the blind rivet element, and
the mandrel is connected to the connecting element on the riveting device by a second thread arrangement comprising the second external thread of the mandrel and the second internal thread of the connecting element; and
starting an emergency program via a user input on the riveting device, the emergency program comprising the steps of:
rotating the connecting element with the rotary drive in a rotating direction to separate the connection between the mandrel with the blind rivet element screwed thereon and the connecting element provided by the second thread arrangement; and, upon reaching a default,
stopping the rotation of the connecting element with the rotary drive.

2. The method as recited in claim 1, wherein,
the riveting device further comprises a rotational lock,
the mandrel is initially rotationally locked relative to the connecting element by the rotational lock, and
the emergency program further comprises the steps of:

releasing the rotational lock prior to the connecting element being rotated with the rotary drive.

3. The method as recited in claim 2, wherein, the riveting device further comprises a sensor, and the emergency program further comprises the steps of:

monitoring a state of the rotational lock via the sensor.

4. The method as recited in claim 1, wherein the emergency program further comprises the steps of:

at least intermittently driving the connecting element axially into the housing of the riveting device with the longitudinal drive during the rotation of the connecting element with the rotary drive.

5. The method as recited in claim 1, wherein, the riveting device further comprises a housing, and the rotary drive and the longitudinal drive are synchronized with each other so that an axial clearance between the housing of the riveting device and the blind rivet element is maintained to be constant during the rotation of the connecting element with the rotary drive.

6. The method as recited in claim 1, wherein the riveting device further comprises a rotary encoder configured to determine a rotational position of the rotary drive.

7. A riveting device comprising a control unit configured to control the method as recited in claim 1.

8. The method as recited in claim 1, further comprising:

removing the mandrel with the blind rivet element screwed thereon from the riveting device; and separating the mandrel from the blind rivet element.

* * * * *